US005470386A

United States Patent [19]

Harris

[11] Patent Number: 5,470,386

[45] Date of Patent: Nov. 28, 1995

[54] LIQUID ADHESIVE APPLICATOR MEANS AND ASSOCIATED METHOD

[75] Inventor: Ira M. Harris, New York, N.Y.

[73] Assignee: Daige, Inc., Albertson, N.Y.

[21] Appl. No.: 88,922

[22] Filed: Jul. 7, 1993

[51] Int. Cl.[6] ..... B05C 1/00

[52] U.S. Cl. ..... 118/244; 118/258

[58] Field of Search ..... 156/578, 441.5, 156/447; 118/244, 248, 258, 259, 261, 262, 267

[56] References Cited

U.S. PATENT DOCUMENTS

| | | | |
|---|---|---|---|
| 701,229 | 5/1902 | Strasburger | 156/446 |
| 2,787,244 | 4/1957 | Hickin | 118/259 |
| 4,104,671 | 1/1976 | Harrigan | 354/337 |
| 4,419,957 | 12/1983 | Voges | 118/261 X |
| 5,230,737 | 7/1993 | Takada et al. | 118/258 X |

FOREIGN PATENT DOCUMENTS 958995 2/1957 Germany .

*Primary Examiner*—James Engel
*Attorney, Agent, or Firm*—Ladas & Parry

[57] ABSTRACT

An applicator for applying liquid adhesive to the surface of a sheet of material in which the applicator has a reservoir containing the liquid adhesive and a cylindrical, rotatable, coating roller in operative communication with the reservoir to apply a wide layer of uniform thickness of the adhesive onto the surface. A cover is provided for selectively enclosing the coating roller and the reservoir and providing a substantially air-tight closure of the reservoir and coating roller to inhibit drying of the liquid adhesive. The adhesive remains in liquid state in the reservoir in readiness for use without external heating. The applicator can be in the form of a portable, hand-held unit or a motor-driven automatic unit.

17 Claims, 4 Drawing Sheets

LIQUID ADHESIVE APPLICATOR MEANS AND ASSOCIATED METHOD

FIELD OF THE INVENTION

The invention relates to an adhesive applicator means and particularly to apparatus for applying liquid adhesive in a wide strip of uniform thickness on the surface of an article such as paper, cardboard or the like.

The invention is particularly related to apparatus of the above type having a coating roller for applying the adhesive which is cylindrical and rotatable.

The apparatus of the invention can be in the form of a portable, hand-held applicator unit or an automatic motor-driven applicator unit.

The invention also relates to methods associated with the apparatus.

BACKGROUND OF THE INVENTION

Known in the art are hand-held units for manually applying an adhesive layer onto the surface of an article. Also known are automatic motor-driven units in which the adhesive layer is automatically applied onto the surface of an article driven by rollers through the automatic unit.

In a class of hand-held units known as hand waxers, a block of solid wax is placed in the unit and an electrical heater in the unit melts the wax to enable it to be applied in a hot, melted state onto the intended surface to be coated. These hand waxers include chambers which receive the solid block of wax and which form reservoirs for the liquid wax after it is melted. When the supply of electrical current to the heater is turned off, the wax becomes solid and requires subsequent heating in order to be liquified. The hand waxers require a source of electrical current and include an electrical cable for attachment to the power source and a switch to turn the electrical heater on and off. The hand waxers include a housing with an elongated handle thermally isolated from the wax reservoir so that the hand waxer can be comfortably held by the user without contacting hot parts of the hand waxer. The handle extends perpendicularly to the roller and the hand waxer is moved in the longitudinal direction of the handle. The coating roller of the hand waxer is exposed at the lower surface of the housing of the hand waxer and the reservoir is placed above the roller so that it can supply melted wax to the roller for application onto the surface to be coated. When not in use, the housing of the hand waxer is supported in a holding stand which securely supports the hand waxer and conceals the coating roller.

Also known in the art are glue bottles with self-contained applicators usually in the form a soft pad on top of the glue bottle. The adhesive contained in the glue bottle is supplied to the pad which is pressed on the surface to apply a coating of adhesive thereon. In another form of glue bottle, a spherical or small plastic roller is disposed at the tip of the bottle. These units are not refillable and are intended as spot applicators which are discarded when empty. In contrast with the hand waxers, the glue bottles do not apply a uniform thickness layer with precision on the surface of the article, but rather apply bumpy and uneven amounts of adhesive which can even soak through the article, particularly when it is made of relatively thin paper. The width of the coating layer is insignificant compared to the width of the layer applied by the hand waxers. The demand in the industry is for application of a wide, precision coating for mounting or adhering the adhesively coated surface to other surfaces.

In the case of automatic adhesive applicators, these are of greater size and are intended to be placed on a table top for application of the liquid adhesive generally over the entire width of a sheet of material. The automatic adhesive applicators employ a motor drive to rotate the coating roller and a counter roller and in operation the material is fed between the rollers and advanced therethrough, so that the material is provided with an adhesive coating on the surface thereof which comes into contact with the coating roller. The motor drive is usually provided by an electrical motor and an electrical power source supplies the drive of the motor as well as the energy to the heating means which melts the wax placed in a reservoir adjacent to the coating roller.

Also known in the art are gluers which are similar to the automatic wax coaters, except that they contain a tank for liquid adhesive which must be removed after each day of use as otherwise the adhesive will solidify.

SUMMARY OF THE INVENTION

An object of the invention is to provide an adhesive applicator means in the form either of a portable, manual hand-held unit, or an automatic table top unit which has a refillable reservoir containing a liquid adhesive which remains in the applicator means without removal and which is protected by removable cover means for providing a substantially air-tight closure for inhibiting drying out of the liquid adhesive.

In accordance with the invention, the apparatus preserves the adhesive in its liquid state in readiness for use, without external heating, to apply a uniformly thin layer of the adhesive to the surface to be coated.

In the case of the portable hand-held unit, this unit can be freely transported for use as it does not require connection to an electrical power supply.

Since the hand-held unit is not heated, the reservoir can be employed as the manually engageable part of the unit and special thermally isolated handles are not required as in the conventional electrically heated models.

A feature of the portable hand-held unit is that it can be refilled as and when necessary with liquid adhesive and is immediately ready for use without any need for melting of wax as in the solid wax models.

Because the reservoir can be employed as the manually engaging portion of the hand-held unit, it can be engaged in the palm of the hand of the user instead of being pushed and pulled by a handle as in the conventional models. This not only makes the construction of the hand-held unit of the invention more compact, but in addition it is easier for the user to see where the adhesive coating has been applied as it is being rolled onto the surface of the material.

In further accordance with the invention, the removable cover means of the hand-held unit is detached from the reservoir when the unit is to be used and after use it is replaced on the reservoir to provide the air-tight closure of the reservoir and roller.

According to a feature of the invention, the reservoir of the hand-held unit has the roller mounted at one end thereof and at its opposite end, the reservoir is provided with a filling spout. The cover means comprises a separate cover mounted at each end of the reservoir. According to a feature of the invention the covers are identical and interchangeable.

In a preferred arrangement, the covers are slidably fitted onto the reservoir at the ends thereof and detents can be provided to establish a snap fit.

In the automatic embodiment of the adhesive applicator, the cover means comprises a roller cover which is hingably mounted on a base to be movable between first and second selected positions in which in the first position the cover encloses the coating roller and the reservoir, while in the second position the cover is displaced away from the coating roller to provide access thereto for an adhesive application operation.

The invention also contemplates a method of applying liquid adhesive to the surface of an article which comprises:

storing liquid adhesive in a reservoir, supplying the liquid adhesive in the reservoir to a cylindrical coating roller in an unheated state at room temperature, applying the liquid adhesive from the coating roller onto the surface of an article to be coated, and providing an air inhibiting closure around the coating roller and reservoir when not applying liquid adhesive to prevent drying of the liquid adhesive and preservation of its liquid state in readiness, without external heating, for subsequent application of a uniformly thin layer of said adhesive to the surface to be coated.

DETAILED DESCRIPTION OF PREFERRED EMBODIMENTS

Figure 1:
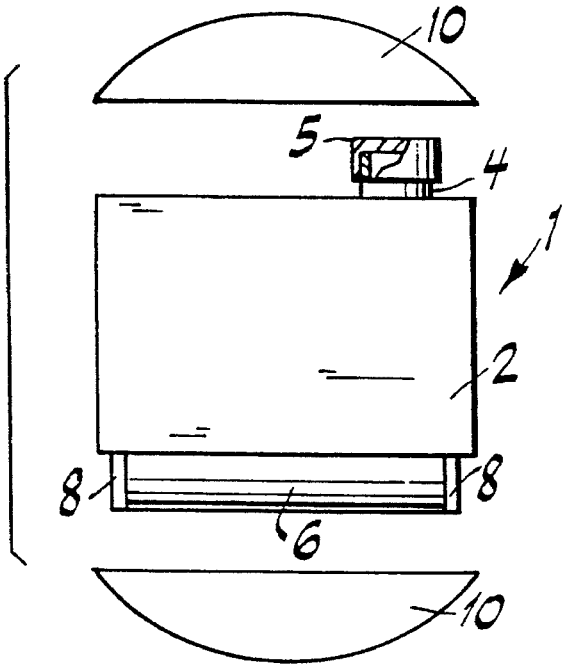
FIG. 1 is a side elevational view, partly broken away in section, of a hand-held, portable unit of a liquid adhesive applicator according to the invention, the portable unit having detachable end covers which are shown separated from the body of the unit.
Figure 2:
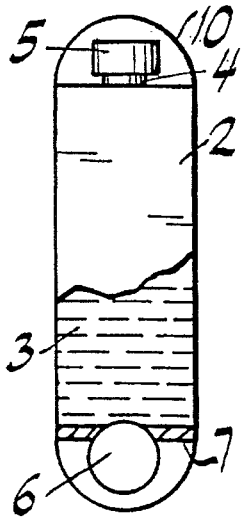
FIG. 2 is an end elevational view of the unit in FIG. 1, partly broken away and in section, with the covers in place.
Figure 3:
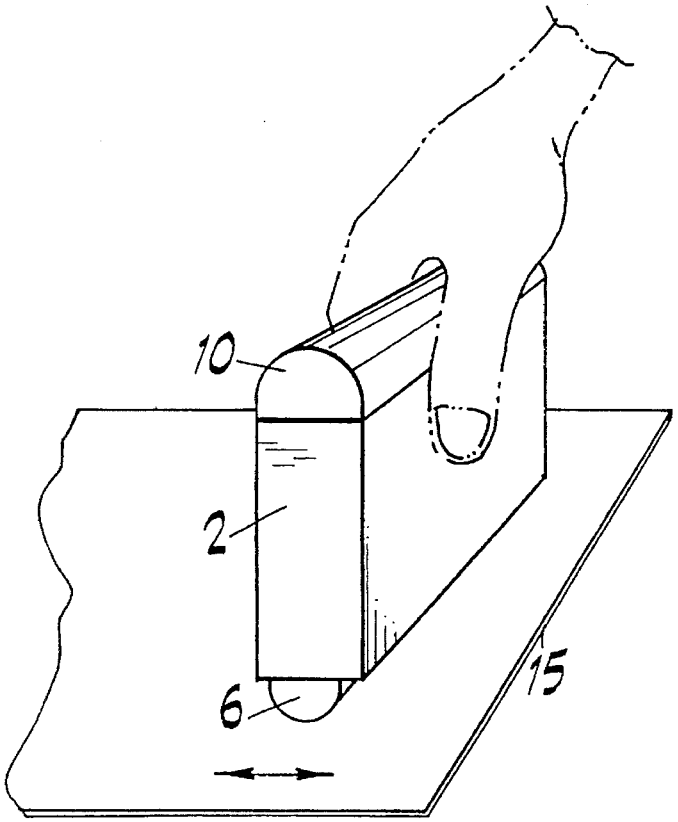
FIG. 3 is a diagrammatic, perspective view showing the portable unit during an adhesive application operation.

FIG. 1 shows a hand-held, portable unit 1 for manually applying a layer of adhesive onto the surface of an article. The unit 1 comprises a hollow body 2 serving as a reservoir for liquid adhesive 3 and as a manually engageable part for applying the adhesive as shown in FIG. 3 and as will be explained later.

The hollow body 2 contains the liquid adhesive 3 and is refillable through a spout 4 provided at one end of the body 2. A removable cap 5 covers spout 4 except when the body 2 is to be filled with adhesive. The cap 5 snugly fits on the spout 4 to provide an air-tight closure therefor.

At its opposite end, the body 2 rotatably supports a cylindrical coating roller 6. A gasket 7 is fitted on the body 2 and engages the roller 6 to wipe the roller and prevent outflow of the liquid adhesive from the body except via the coating roller 6. The gasket 7 is conventional as is the coating roller 6 which comprises a knurled, metal roller, such as aluminum. The coating roller 6 is rotatably supported in brackets 8 integral with the body 2.

The portable unit 1 further comprises two identical and interchangeable covers 10 which can be respectively fitted on the opposite ends of body 2 in air-tight manner. The covers 10 and body 2 are made of plastic material to promote the air-tight engagement thereof. The air-tight connection of the covers 10 and the body 2 is essential to prevent drying of the liquid adhesive and preserve it in liquid state in readiness for a subsequent coating operation without need for external heating. It is particularly important to enclose the roller 6 and the adhesive reservoir in hollow body 2 in air-tight manner.

Figure 4:
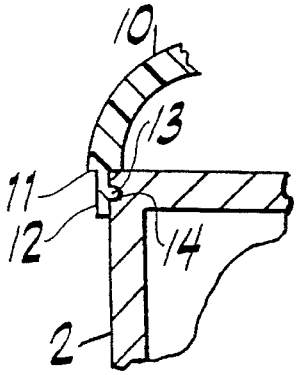
FIG. 4 is an enlarged sectional view of a detail of the connection of a cover to the body of the portable unit.

In a particular arrangement as shown in FIG. 4 the cover 10 is of dome-shape and has an annular rim or edge 11 with a lip 12 which is slidably fitted on the outer surface of body 2 for engagement and disengagement of the cover 10 and the body 2. In order to provide a snap fit of the cover 10 on the body 2, the lip 12 is provided with detents 13 which can engage in recesses 14 in the body 2.

In operation, liquid adhesive is filled in the hollow body 2 and remains therein in liquid state in readiness for use. The covers 10 are fitted on the body 2 in air-tight relation to inhibit drying of the liquid adhesive both on the roller 6 and in the reservoir in body 2. When the unit 1 is to be used, the cover 10 covering roller 6 is removed from the body 2 and the body 2 is manually engaged as shown in FIG. 3 to press the roller 6 against the material 15 while the body is moved in the direction of the arrows to roll the roller 6 on the surface of the material 15 to apply a coating layer of the liquid adhesive thereon. The material 15 can be paper, cardboard or the like and can constitute photographs, displays or other visual material to be adhered to another surface. The coating applied by the roller 6 is consistently thin and smooth, without bumps, and without soaking through the material 15. Moreover, because the roller 6 is cylindrical and has substantial length, usually a minimum of 2½", a wide strip of adhesive is applied to material 15.

The body 2 is of generally rectangular or parallelipiped shape which has been found to be particularly easy to use in applying the liquid adhesive coating. Finger grips or other enhancements can be provided on the body 2 if desired.

Figure 5:
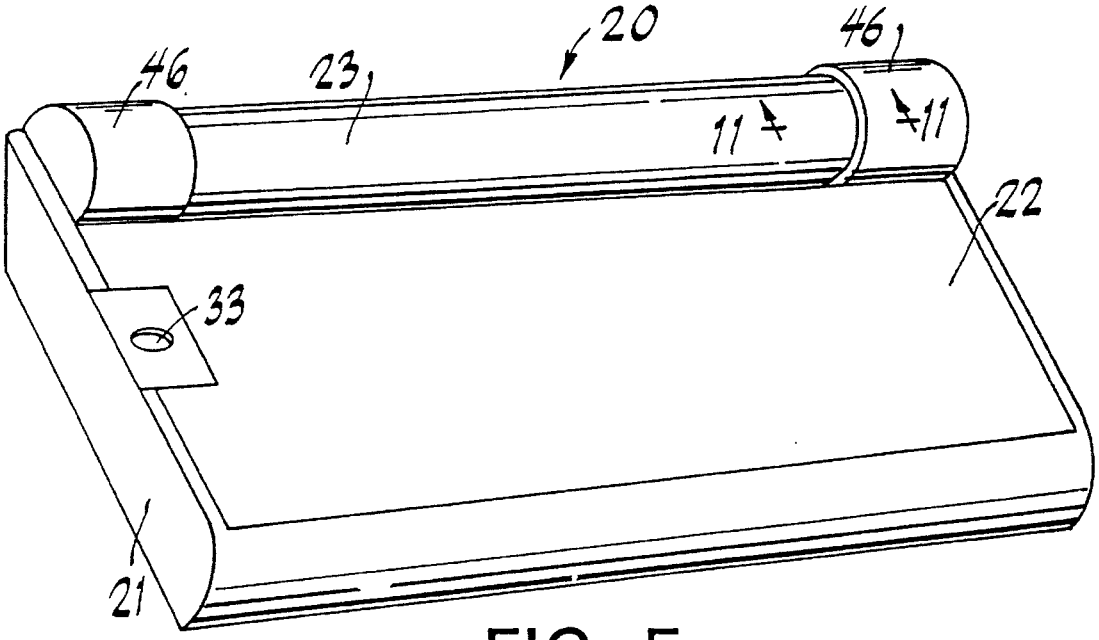
FIG. 5 is a front, top, perspective view of an automatic adhesive applicator unit according to the invention.
Figure 10:
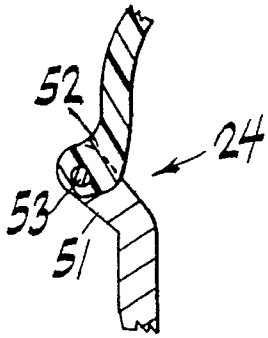
FIG. 10 is a transverse sectional view through the assembled hinge.
Figure 7:
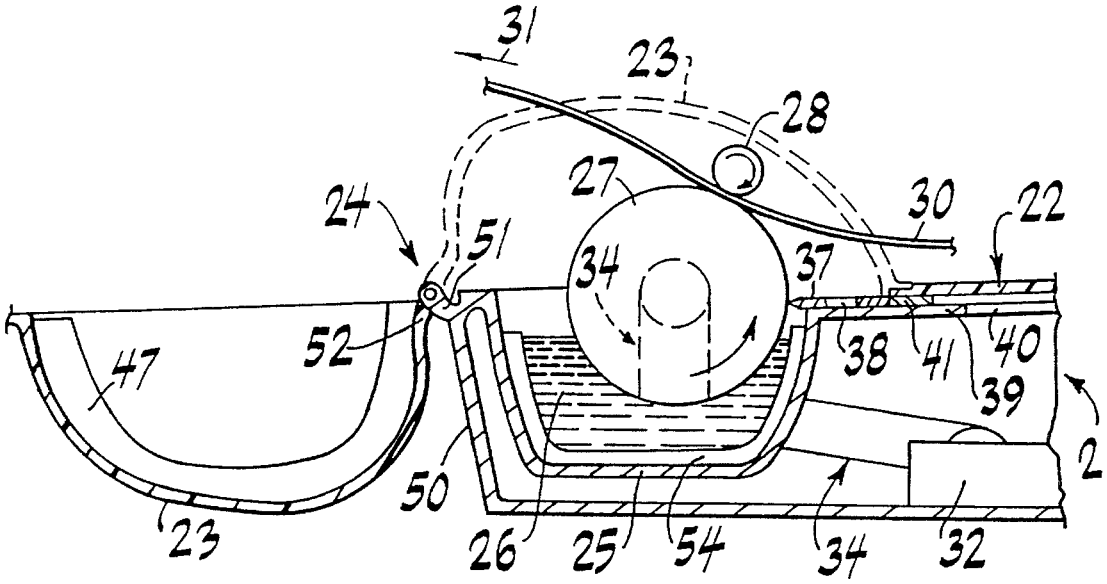
FIG. 7 is a sectional view taken along line 7—7 in FIG. 6.
Figure 8:
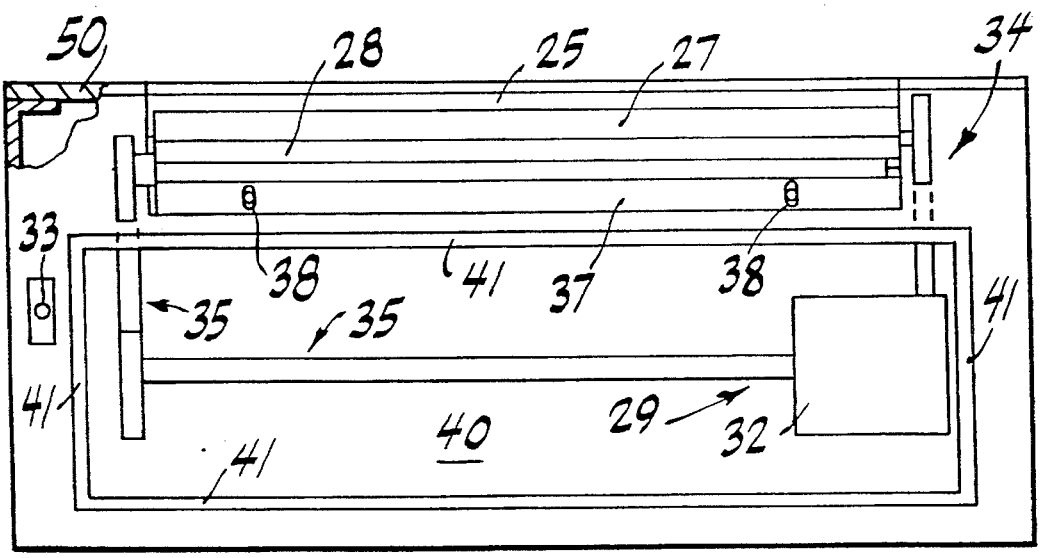
FIG. 8 is a top plan view of the base of the automatic unit with the roller cover and deck cover thereof removed.
Figure 9:
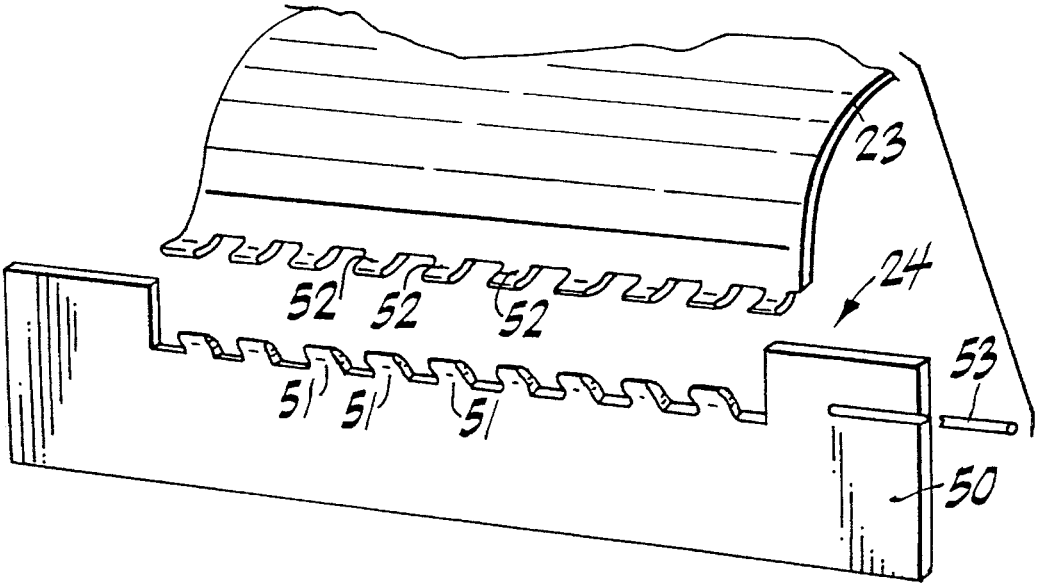
FIG. 9 is an exploded view of a hinge connecting the roller cover to the base.

FIG. 5 shows an automatic, motor-driven adhesive applicator unit 20 according to the invention. The unit 20 comprises a base 21, a deck cover 22 covering the top of the base 21 and a roller cover 23. The roller cover 23 is connected to base 21 by a hinge assembly 24 (shown in FIGS. 5, 7, 9 and 10 and to be described in more detail later) for pivotal movement between an open position as shown in solid lines in FIG. 7 and a closed position shown in dotted outline in FIG. 7. The base 21 is formed with a hollow, open reservoir 25 for containing liquid adhesive 26. The coating roller 27 is similar in construction to the coating roller 6 of the hand-held unit 1. A coating roller 27 extends into the reservoir 25 for being immersed in the liquid adhesive 26. A top roller 28 is positioned adjacent to the coating roller 27 to serve as a counter roller and the coating roller 27 and top roller 28 are driven in rotation by a motor drive means 29 in opposite directions as shown by the arrows in FIG. 7 to advance a sheet of material 30 inserted between the rollers 27, 28 in the direction of arrow 31.

In order to prevent drying out of the liquid adhesive 26 in the reservoir 25 and on the coating roller 27, the invention provides for the separate deck cover 22 which remains fixed in place on the base 21 and the pivotal roller cover 23, which when closed inhibits the drying out of the liquid adhesive in the reservoir 25 and on the roller 27. To promote the inhibiting effect of drying out of the adhesive, the invention contemplates various means for sealing the reservoir 25 against the ambient atmosphere and for latching the roller cover 23 in its closed position. This will be explained in more detail hereafter.

The base 21 is hollow and contains a drive motor 32 forming part of the drive means 29 which drives the rollers 27 and 28. The motor 32 is operated by a switch 33 which selectively connects the motor to an external electrical power supply (not shown). The motor 32 is supported within the hollow base 21 and drives a transmission 34 comprised of gears, belts and pulleys coupled to the roller 27 to drive the same in rotation. The motor 29 also drives a transmission 35 comprised of gears, belts and pulleys to drive the roller 28 in rotation. The rollers 27 and 28 are driven at respective speeds to advance the sheet of material 30 between the rollers. The rollers 27 and 28 are supported at their ends remote from their driven ends in bearings which provide free rotation of the rollers. A doctor blade 37 is radially positioned adjacent to coating roller 37 to control the thickness of adhesive on the coating roller 27 and thereby the thickness of the coating which is applied to the sheet of material 30. The doctor blade 37 is supported at its ends in elongated slots 38 to enable the spacing between the doctor blade 37 and the coating roller 27 to be adjusted to regulate the thickness of the adhesive on the coating roller 27. A top wall 39 of the hollow base is provided with an opening 40 to provide access to the interior of base 21 and in particular to the motor 32 and the other elements of the drive means 29 therein.

In order to block communication between ambient atmosphere in the hollow base 21 and the reservoir 25 and rollers 27 and 28, a seal 41 surrounds the opening 40. The seal 41 is provided between deck cover 22 and top wall 39. The seal 41 can be formed from a foam, plastic material, a rubber gasket material or the like and the seal can be placed on the deck cover 22, the top wall 39 of the base or both.

Figure 11:
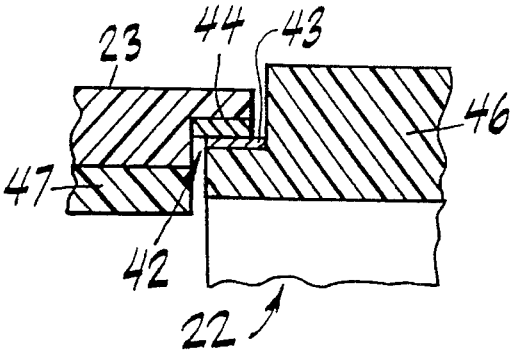
FIG. 11 is a sectional view, on enlarged scale, taken along line 11—11 in FIG. 5.
Figure 6:
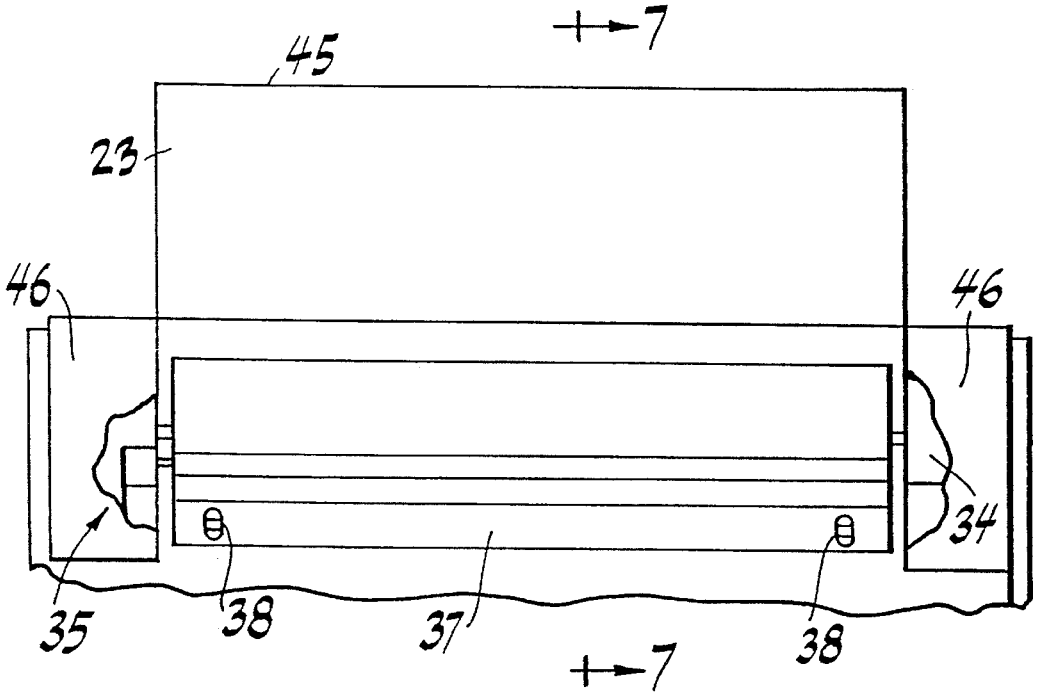
FIG. 6 is a top plan view of a portion of the unit in FIG. 5 with a roller cover thereof in open position.

If close tolerances are provided between the roller cover 23 and the deck cover 22, this may be sufficient to prevent drying out of the adhesive in the reservoir 25 and on the coating roller 27. However, according to an advantageous embodiment, the roller cover 23 is provided with latching means 42 having the dual function of holding the roller cover 23 in its closed position while also providing a sealing function. As shown in FIG. 11, the latching means 42 comprises a magnetic tape 43 on the deck cover 22 and a thin metal shim 44 on the roller cover 23. The latching means 42 is placed on opposite lateral sides of the roller cover 23 so that when the roller cover is in closed position, the latching means will provide a positive latching effect with tight fitting magnetic action preventing air penetration beneath the roller cover at its opposite, lateral sides. If necessary, the latching means 42 can also be provided along the longitudinal edge 45 of the roller cover 23.

The deck cover 22 comprises a flat portion with integral, bent dome-like pavilions 46 which respectively cover the transmissions 34 and 35 at the opposite sides of the base 21. The latching means 42 extends along opposed, bent curved surfaces of the roller cover 23 and the pavilions 46 to provide the latching and sealing action.

To further inhibit drying of the adhesive 26 it has been found effective to provide a layer of foam material 47 covering the inner surface of the roller cover 23.

The hinge means 24 which pivotably connects the roller cover 23 to the base 21 comprises a hinge plate 50 which forms the back wall of the base 21. The hinge plate 50 is formed with outwardly bent teeth 51 and the back edge of cover 23 is formed with outwardly bent teeth 52. The teeth mesh with one another and engage a pin 53 to provide the hinge connection for the roller cover 23 for its movement between its open and closed positions.

The reservoir 25 may contain a removable tray 54 of plastic material or the like which is periodically removed and washed to maintain clean conditions. When liquid adhesive is to be added to the reservoir 25 (or tray 54) from time to time, the liquid adhesive is poured into the reservoir 25 at the rear thereof.

In operation, when the surface of a sheet of material 30 is to be coated with adhesive, the roller cover 23 is pivotably moved to its open position and the edge of the sheet of material 30 is introduced into the nip between the rollers 27 and 28. The switch 33 is actuated to drive the motor 32 and the rollers 27, 28 to advance the sheet of material 30 through the rollers. A thin, uniform coating of adhesive will be applied onto the surface of the sheet of material which is in contact with the coating roller 27. After the adhesive coating has been applied to the sheet of material 30, the roller cover 23 is brought to its closed position to inhibit contact of the adhesive in the reservoir 25 and on the roller 27 with the ambient atmosphere and prevent drying out of the adhesive.

Although the invention has been described with reference to specific embodiments thereof, it will become apparent to those skilled in the art that numerous modifications and variations can be made within the scope and spirit of the invention as defined by the attached claims.

What is claimed is:

1. A portable, hand-held adhesive applicator comprising a reservoir containing liquid adhesive, said liquid adhesive being maintained in said reservoir in an unheated liquid state at room temperature, a cylindrical, rotatable, coating roller in operative communication with said reservoir to receive liquid adhesive from the reservoir for application of a layer of uniform thickness of said adhesive onto a surface to be coated with the adhesive, a removable cover means for selectively enclosing or exposing the coating roller, and means to provide a substantially air-tight closure of the reservoir and coating roller with respect to ambient atmosphere for inhibiting drying of the liquid adhesive when the cover means encloses the coating roller and reservoir whereby the adhesive remains in liquid state in readiness for use, without external heating, to apply a uniformly thin layer of said adhesive onto the surface to be coated, said reservoir having an opening for refilling the reservoir with liquid adhesive, said refilling opening being remote from said coating roller, said reservoir having opposite ends, said coating roller being at one of said ends, said refilling opening including a filling spout at the other of said ends, said filling spout including a removable cap thereon, said cover means comprising a first cover at said one of said ends enclosing the coating roller and a second cover at said other of said ends enclosing said filling spouts and said removable cap, said first and second covers being respectively and independently separable from said reservoir, said reservoir including a portion exposed between said first and second covers and shaped for manual engagement in a hand-held operation of said unit.

2. Adhesive applicator as claimed in claim 1, wherein said first and second covers are identical and interchangeable.

3. Adhesive applicator means as claimed in claim 1, wherein said reservoir has a parallelipiped shape.

4. Adhesive applicator means as claimed in claim 1, wherein each of said covers includes means for providing a slidable fit with said reservoir at either of said ends thereof to provide said air-tight closure with said reservoir thereat.

5. Adhesive applicator means as claimed in claim 4, wherein each said cover is of dome shape with an annular rim, said means for providing a slidable fit of the cover with the reservoir comprising a lip on said annular rim slidably fittable on either of said ends of said reservoir.

6. An automatic adhesive applicator comprising a reservoir containing liquid adhesive, said liquid adhesive being maintained in said reservoir in an unheated liquid state at room temperature, a cylindrical, rotatable, coating roller in operative communication with said reservoir to receive liquid adhesive from the reservoir for application of a layer of uniform thickness of said adhesive onto a surface to be coated with the adhesive, a movable cover means for selectively enclosing the coating roller and the reservoir, and means to provide a substantially air-tight closure of the reservoir and coating roller with respect to ambient atmosphere for inhibiting drying of the liquid adhesive when the movable cover means encloses the coating roller and reservoir whereby the adhesive remains in liquid state in readiness for use, without external heating, to apply a uniformly thin layer of said adhesive onto the surface to be coated, said applicator further comprising a base supporting said reservoir and said coating roller, the application of adhesive to the surface to be coated being effected by passing an article whose surface is to be coated on the coating roller, said cover means comprising a roller cover having a first position in which the roller cover encloses the coating roller with said air-tight closure, and a second position in which the roller cover is displaced away from the coating roller to provide access thereto for application of adhesive onto said surface, a counter roller facing said coating roller for feeding therebetween the article whose surface is to be coated with adhesive by said coating roller, drive means for driving said coating roller and said counter roller in rotation, and a deck cover on said base, said deck cover including a flat portion and two spaced dome-like pavilions projecting above said flat portion, said roller cover being fitted between said pavilions, said roller cover having lateral edges which in said first position of the roller cover face said pavilions and a transverse edge extending between said lateral edges facing said flat section of the deck cover.

7. Adhesive applicator as claimed in claim 6, comprising means hingably connecting the roller cover to said base for movement between said first and second positions.

8. Adhesive applicator means as claimed in claim 6, wherein said means hingably connecting the roller cover to the base comprises a hinge plate on said base.

9. Adhesive applicator as claimed in claim 6, wherein said means to provide a substantially air-tight enclosure comprises magnetic latch means on said roller cover.

10. Adhesive applicator as claimed in claim 6, further comprising a removable tray in said reservoir.

11. Adhesive applicator as claimed in claim 6, wherein said counter roller and a portion of said coating roller extend above said flat portion of said deck cover, said roller cover being bent to form a hollow space enclosing said counter roller and said coating roller in said first position, said dome like pavilions of said deck cover being of complementary shape to said roller cover.

12. Adhesive applicator as claimed in claim 6, wherein said means to provide a substantially air-tight closure comprises seal means for sealing said lateral edges of said roller cover and said pavilions when the roller cover is in said first position.

13. Adhesive applicator as claimed in claim 11, wherein said seal means comprises a magnetic tape on one of said covers and a metal skin on the other of said covers to provide magnetic latching of said roller cover in said first position.

14. Adhesive applicator as claimed in claim 1, wherein said first cover and said reservoir include means for providing a snap fit closure for said first cover on the reservoir.

15. Adhesive applicator as claimed in claim 11, wherein said drive means for said coating roller and said counter roller includes elements disposed in a hollow space formed by said dome-like pavilions, said elements of said drive means being sealed off from said reservoir when the roller cover is in said first position.

16. Adhesive applicator as claimed in claim 15, comprising means to impede air flow from within the deck cover to the reservoir and said rollers.

17. Adhesive applicator as claimed in claim 15, wherein said means to impede air flow comprises a seal between said deck and said base.

* * * * *